United States Patent [19]

Dunphy

[11] 3,943,499

[45] Mar. 9, 1976

[54] PORTABLE FIRE DETECTOR

[75] Inventor: Matthew J. Dunphy, Braintree, Mass.

[73] Assignee: Pyrotector, Incorporated, Mass.

[22] Filed: Apr. 16, 1974

[21] Appl. No.: 461,297

[52] U.S. Cl. ..... 340/227 R; 340/283; 200/153 A

[51] Int. Cl.[2] ..... G08B 21/00

[58] Field of Search ..... 340/227 R, 227.1, 228, 340/283, 114; 200/153 A, 187, 224

[56] References Cited

UNITED STATES PATENTS

| | | | |
|---|---|---|---|
| 3,517,382 | 6/1970 | Stein et al. | 340/227 R |
| 3,660,817 | 5/1972 | Abrams | 340/114 |

*Primary Examiner*—John W. Caldwell
*Assistant Examiner*—William M. Wannisky
*Attorney, Agent, or Firm*—Robert E. Ross

[57] ABSTRACT

A portable fire alarm device comprising fire detecting means and alarm means powered from a self-contained power supply. The power to the detector and alarm is through a normally closed switch of the type such as a mercury switch which may be opened by tilting the device to a predetermined angle from the vertical so that the alarm may be shut off.

A second normally open switch of the mercury type connects the power supply directly to the alarm device and is so oriented that tilting the device to a predetermined angle from the vertical closes said switch and energizes the alarm to test the condition of the battery.

3 Claims, 2 Drawing Figures

PORTABLE FIRE DETECTOR

DESCRIPTION OF THE ILLUSTRATED EMBODIMENT

Figure 1:
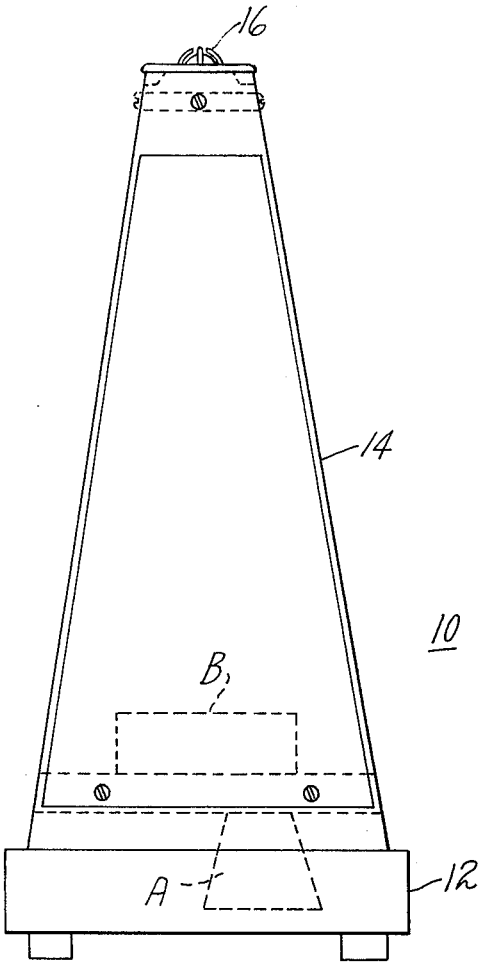
FIG. 1 is a view in side elevation of a portable fire detecting device embodying the features of the invention, with certain internal components being shown in dashed line.

Referring to the drawing, there is illustrated a fire detection device 10 which comprises a base 12, a conical housing 14 projecting upwardly from the base, and a fire detector 16 positioned on the upper end of the housing in such a manner that it can receive fire radiation from any direction.

The device 10 is intended to be readily portable with a self-contained rechargable battery power supply to enable its use in airplane hangers, garages, warehouses, construction sites, and the like.

To provide a housing that is readily visible, distinctive in appearance, and capable of absorbing impact and rough handling without damage, it has been found that a so-called traffic cone may be used. Such a device is commonly formed of molded rubber or resilient plastic, and is usually made in a fluorescent red color. The base 12 may be filled with sand to provide stability.

As illustrated in FIG. 1, the heavier electrical components of the system are mounted near the base to provide additional stability, and the fire detector itself is mounted on the top of the cone so that it may receive fire radiation from 360°.

The detector 16 may be of any desired type. In the illustrated embodiment the detector is of the type that responds to ultra-violet radiation from a flame. Detectors of this type are well known in the art.

Figure 2:
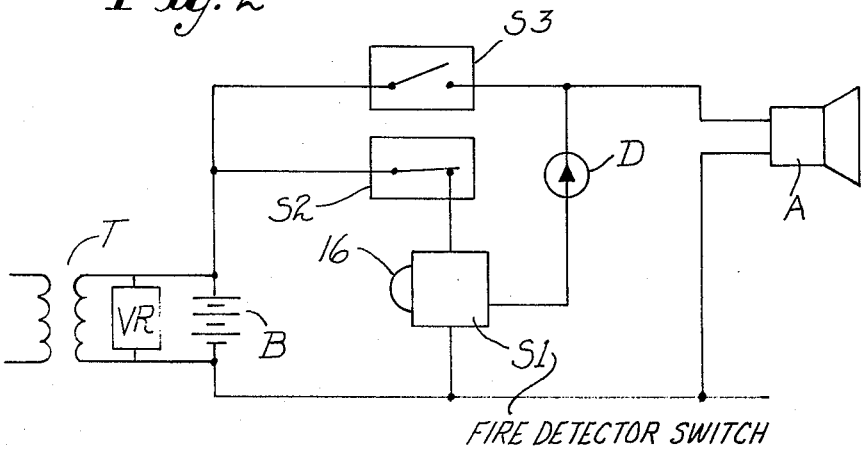
FIG. 2 is a schematic diagram of an electrical circuit used in the device FIG. 1.

Referring to FIG. 2, there is illustrated a schematic diagram of an electrical circuit for use with the device of FIG. 1. The circuit includes a power supply B which preferably is a battery rechargable when necessary from an external source through a line cord transformer T, and a voltage regulator VR.

The detector has an internal switch S1 which may be mechanical or electronic which closes when the detector receives fire radiation, which completes a circuit, through switch S2 and diode D between the alarm device A and the battery B.

The switch S2 is of the gravity-operated type which is opened and closed by tilting, such as a mercury switch, in which two contacts are disposed in a sealed housing containing a quantity of mercury. When the housing is in one orientation, the mercury covers both contacts and completes a circuit therebetween. When the housing is tilted to another orientation, the mercury flows away from at least one of the contacts and the circuit between the contacts is broken.

In the illustrated embodiment the switch S2 is so mounted in relation to the housing that the switch is closed when the housing is in its upright normal position, but opens when the housing is tilted away from the vertical a predetermined amount for a purpose to appear hereinafter.

A second circuit to the alarm device is provided directly from the battery through a second gravity operated switch S3. The switch S3 is so mounted in the housing that when the housing is in the upright position, the switch is open, and the switch is closed by tilting the housing to a predetermined angle away from the vertical.

When the device is in operation, the sensing of a fire by the detector 16 will cause the internal detector switch S1 to close, completing the circuit to the alarm through switch S2. The internal detector circuitry also includes means for locking in the alarm circuit, so that the alarm will continue to sound even if the detector temporarily ceases to sense the fire radiation.

In the illustrated embodiment the locking in of the alarm circuit is effected by the use of an SCR, which is triggered into conductivity by a signal to the gate thereof from the detector. Once triggered into conduction, the SCR will continue to conduct until the alarm circuit is elsewhere broken, regardless of whether or not there is a continuing signal at the gate. The same result can, of course, be achieved by a relay with a holding circuit, as is well known in the art.

The alarm will therefore continue to sound until the circuit thereto is broken by tilting the housing to open switch S2, which de-energizes the alarm and also de-energizes the holding circuit in the detector. The alarm will therefore remain de-energized when the housing is returned to the upright position (assuming that radiation from a fire is no longer being received by the detector).

The operability of the entire device may be tested by lighting a match within a few feet of the detector and the resulting alarm may be shut off in the manner described above.

The switch S3 allows the testing of the alarm and battery circuit by merely tilting the housing away from the vertical a pre-determined amount. The loudness of the alarm provides an indication of battery condition. Since the detector draws only a small fraction of the current drawn by the energized alarm, a loud signal from the alarm indicates that the battery has sufficient charge for operation of the detector for an extended period without recharging the battery.

The provision of switch S3 also provides an alarm, even in the absence of fire, if the housing is inadvertently knocked over, which would render the detector inoperative by reason of the opening of switch S2. Although it is convenient to utilize the same alarm for this purpose, it will be apparent that an alarm having a different sound may be provided if desired to indicate upsetting of the device.

In a particular embodiment of the invention the switch S3 may be oriented so that it closes to sound the alarm when the housing is tilted about 20° away from the vertical, so that it will give an alarm if contacted by a moving vehicle.

Although in the illustrated embodiment the detector 16 is responsive to ultra-violet radiation, for other applications it may be responsive to infra-red, with means provided to enable the detector to discriminate between infra-red from a fire and from other sources, or the detector may be responsive to smoke.

Although mercury switches are used in the illustrated embodiment, other gravity operated switches that open and close with change in orientation may be used.

Since certain other obvious changes may be made in the device without departing from the scope of the invention, it is intended that all matter contained herein be interpreted in an illustrative and not a limiting sense.

I claim:

1. A portable fire detector, comprising a base and an upwardly projecting member, fire detecting means in said upwardly projecting member, and signalling means associated therewith, means responsive to the detection of fire by said fire detection means to energize said signalling means through a first circuit that includes circuit latching means, means responsive to the tilting of said device a predetermined angle away from and back to the vertical to energize and de-energize respectively said signalling device through a second circuit path, and means responsive to the tilting of said device away from the vertical a predetermined amount when the signalling device has been energized by the detector to de-energize the signalling device by breaking the first circuit.

2. A portable fire detector, comprising a base and an upwardly projecting member, fire detecting means on said upwardly projecting member, signalling means for connection to a power source, means responsive to the detection of a fire by said fire detecting means to complete a first circuit from said signalling means to the power source, circuit latching means for thereafter maintaining said circuit, means responsive to the tilting of the upwardly projecting member away from the vertical to break said first circuit, means responsive to the tilting of the upwardly projecting member away from the vertical to complete a second circuit path from the power source to the signalling means, said second circuit being maintained only while the upwardly projecting member is disposed at an angle from the vertical and being broken when the upwardly projecting member is returned to the vertical position.

3. In a portable fire detector unit comprising a base, a member projecting upwardly from the base, a fire detecting device disposed on top of said member, signalling means for connection to a power source, and electrical circuitry responsive to the detection of the presence of fire by the fire detecting means to complete a circuit path between the power source and the signalling means, the improvement comprising a first gravity operated switch connected in said circuit path and being so mounted as to be normally closed when the unit is in the normal upright position and to open when the unit is tilted a predetermined angle away from the vertical, thereby breaking the circuit path to the signalling means and said circuit holding means and a second gravity operated switch connected to provide a second circuit path between the power source and the signalling means, and being so mounted as to be open when the unit is in its normal upright position and closed when the unit is tilted a predetermined angle from the vertical, whereby after said signalling unit is energized through the first circuit path, it may be deenergized by tilting the unit away from the vertical to an angle such that the first gravity operated switch is opened and returning it to the upright position, and the signalling device may be energized independently of the detection of a fire for test purposes by tilting said unit away from the vertical to an angle such that the second gravity operated switch is closed.

* * * * *